United States Patent [19]

Goetz

[11] Patent Number: 4,690,343

[45] Date of Patent: Sep. 1, 1987

[54] PAPER ROLL HOLDER WITH TENSION ARM

[76] Inventor: Harold E. Goetz, 1004 First, Dodge City, Kans. 67801

[21] Appl. No.: 817,118

[22] Filed: Jan. 8, 1986

[51] Int. Cl.[4] ..... B65H 16/04

[52] U.S. Cl. ..... 242/55.3; 242/55.2

[58] Field of Search ..... 242/55.2, 55.3, 55.53, 242/55.55, 68.3, 129.5; 225/46

[56] References Cited

U.S. PATENT DOCUMENTS

| | | | |
|---|---|---|---|
| 1,398,646 | 11/1921 | Murray . | |
| 2,240,109 | 4/1941 | Baldwin et al. | 242/55.2 |
| 2,386,408 | 10/1945 | Schiff | 242/55.3 |
| 2,482,871 | 9/1949 | Rapport | 242/55.2 |
| 2,510,537 | 6/1950 | Agamate | 242/55.3 |
| 2,619,297 | 11/1962 | Sharrer | 242/55.3 |
| 2,632,606 | 3/1953 | Krueger | 242/55.2 |
| 2,697,562 | 12/1954 | Langer | 242/55.3 |
| 2,858,995 | 11/1958 | Sarro | 242/55.3 |
| 2,861,751 | 11/1958 | Sarro | 242/55.3 |
| 3,841,576 | 10/1974 | Farrer | 242/55.2 |
| 4,235,389 | 11/1980 | Ness | 242/55.2 |

*Primary Examiner*—John M. Jillions

*Attorney, Agent, or Firm*—Harvey B. Jacobson

[57] ABSTRACT

Paper roll holders are formed of wire rod and provide a pair of holder devices on opposite sides of a central support. Each holder device has a support arm and a resilient tension arm together defining a push-on, pull-off type paper roll holder. The tension arms are specifically designed to reduce tension and equalize pressure on the respective paper rolls.

14 Claims, 7 Drawing Figures

PAPER ROLL HOLDER WITH TENSION ARM

BACKGROUND OF THE INVENTION

This invention relates to paper roll holders particularly suited for supporting toilet tissue rolls and the like, but also suited for use with other types of paper rolls and the like. While the invention is described herein as relating to holders for paper rolls, the term "paper" is used in an exemplary sense to facilitate description of the invention and it is not intended to limit the invention, since the holders described and claimed herein can be used for rolls of other sheet material such as plastic or metal foil.

SUMMARY OF THE INVENTION

It is an object of the invention to provide a versatile type of holder structure for paper rolls and the like which can be adapted to diverse commercial and domestic applications; which can have the core of a used roll removed therefrom with one hand without requiring dismantling of the structure; which can similarly have a fresh roll inserted thereon with one hand and without requiring any dismantling of the structure; which will firmly retain a roll thereon while still permitting ready unwinding of the roll; and which lends itself to incorporation of a night light, cigarette lighter or locking mechanism with the holder structure. More particularly, it is an object of the invention to provide a push-on, pull-off type paper roll holder which may be readily constructed from wire rod material and which has tension arms designed to effectively reduce tension and provide substantial uniform pressure on all parts of a roll.

A paper roll holder in accordance with the invention is formed from resilient rod-like material, conveniently spring steel, which is formed with a support arm extending cantilever-wise from a support and a tension arm extending from the support arm in juxtaposition thereto for gripping and retaining a roll pressed onto the arms by tension developed therebetween, the roll having a core with a diameter slightly smaller than the spacing of the arms. Preferably, the tension arm has a first step adjacent its junction with the support arm and a second step leading to a roll-engaging portion of the tension arm which is parallel to the support arm and of substantially shorter length, for example, of the order of half the overall length of the support arm. The roll engaging portion of the tension arm is intended to extend only along a part of the length of a paper roll core. The stepped formation of the tension arm and the reduced length rollengaging section thereof are effective in reducing tension and providing uniform pressure on a paper roll as aforesaid.

In a preferred form of the invention, a pair of roll holder devices may be provided on opposite sides of a common central support. The respective support arms extend oppositely from the support and the respective tension arms extend from the free ends of the support arms to the opposite side of the device. In a further preferred form of the invention, a pair of support arms may be formed as the upper and lower limbs of a rod-like frame shaped as an elongate S, with the tension arms extending from inboard ends of the respective limbs.

Holders in accordance with the invention may be provided in models to fit in a wall recess or to project from a wall. They might also be provided with central locking arrangements, lights or other fittings.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 3:
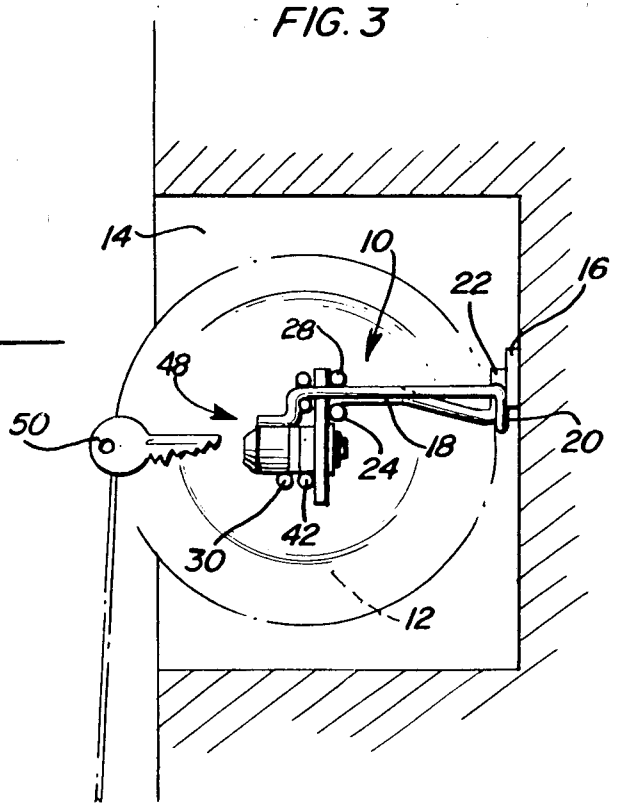
FIG. 3 is an end view of the holder.
Figure 1:
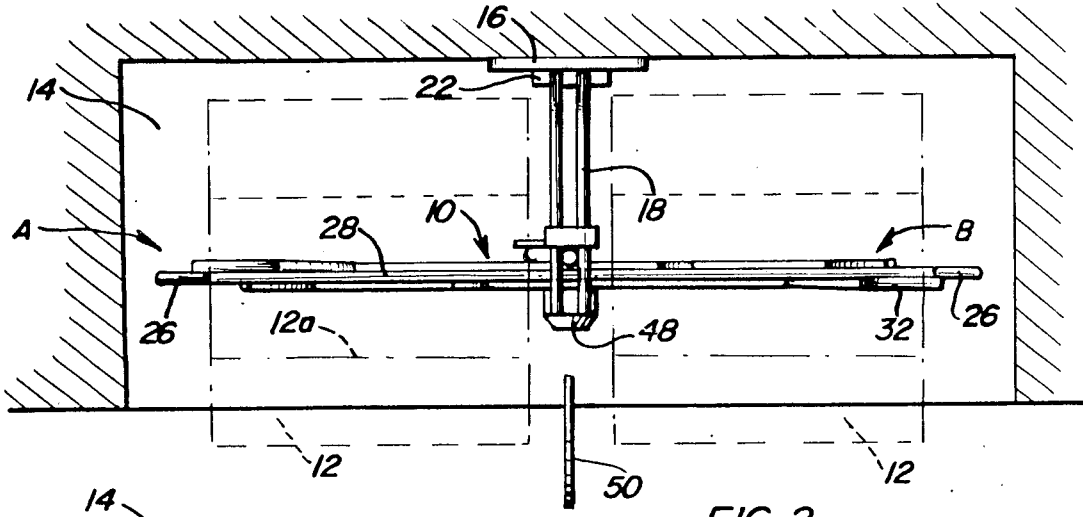
FIG. 1 is a plan view of a first form of paper roll holder in accordance with the invention mounted in a wall recess.
Figure 2:
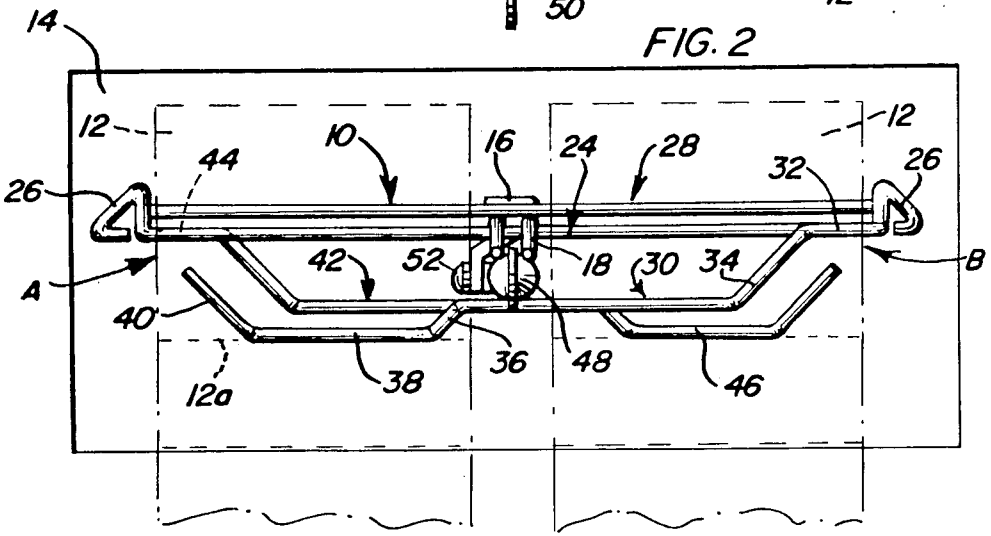
FIG. 2 is an elevational view of the holder.

Referring initially to FIGS. 1 to 3, there is shown a first form of paper roll holder 10, particularly for a pair of toilet paper rolls 12, the holder being mounted in a wall recess 14 and being made of resilient rod material such as spring steel rod of one-eighth inch or three-sixteenths inch diameter, or combinations thereof.

Holder 10 has a central mounting bracket assembly comprising a mounting plate 16 and arms 18 extending forwardly from the plate. The arms may be formed into a loop or hook 20 at the back for releasable receipt in a retention pocket 22 in plate 16 which is screwed onto the wall. Welded to arms 18 is an assembly of rods shaped and assembled, as will be described to provide left and right hand push-on, pull-off type roll holder sections A and B extending cantilever-wise from the support. The holder is formed predominantly from four elongate rods. A first rod 24 is centrally welded to the bottom of arms 18 and has its free ends formed as generally triangular headed portions 26. A second rod 28 is centrally welded to the top of arms 18 over rod 24 and has its ends welded to headed portions 26. Rods 24 and 28 form support arms for the respective holder sections A and B. A third rod 30 has one end portion 32 welded to the front of rod 24 at its right hand end, rod 30 having a first step 34, and a second step 36, the latter leading to a rod section 38 which is parallel to rods 24 and 28. The free end portion 40 of rod 30 is bent upwardly. Rod 30 forms a tension arm for the left hand holder section A with rod section 38 forming a rollengaging section which contacts interior of core 12*a* of roll 12. It will be noted that section 38 is shorter than core 12*a* and its spacing from rod 24 is slightly greater than the core diameter. Accordingly, when the holder is removed from recess 14, roll 12 can be worked over headed section 26 and onto holder device A where it is resiliently held in place by tension developed in rod 30. The design of section 38 serves to reduce tension of the paper roll and provide uniform pressure. The holder includes a fourth rod 42 of similar shape to rod 30 providing a tension arm for holder device B. Rod 42 has an end section 44 welded at the left end of holder 10 to the back of rod 28 and rod 42 again has a double step formation providing a roll-engaging section 46 of like character to section 38 of rod 30. Thus, device B operates in like manner to device A.

The holder may be provided with a central lock 48 operated by a key 50, the lock having a key-actuated rotary tab 52 which can be rotated to engage the central sections of the respective rods 30, 42 to prevent the rods from being flexed upwardly, thereby preventing a roll from being pulled off the holder past one of the headed portions 26, so as to prevent theft of the rolls. The lock may be of the kind disclosed in my co-pending patent application Ser. No. 729,952, filed May 2, 1985, now U.S. Pat. No. 4,595,153, issued June 17, 1986, and the disclosure of which is expressly incorporated herein by reference. Also, holder 10 may be provided with a central light fitting, not shown, as disclosed in the co-pending application.

Figure 6:
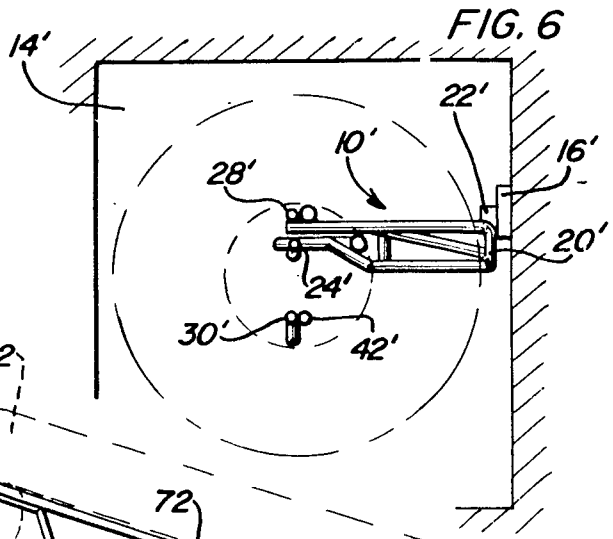
FIG. 6 is a view similar to FIG. 3 of the second form of holder.
Figure 4:
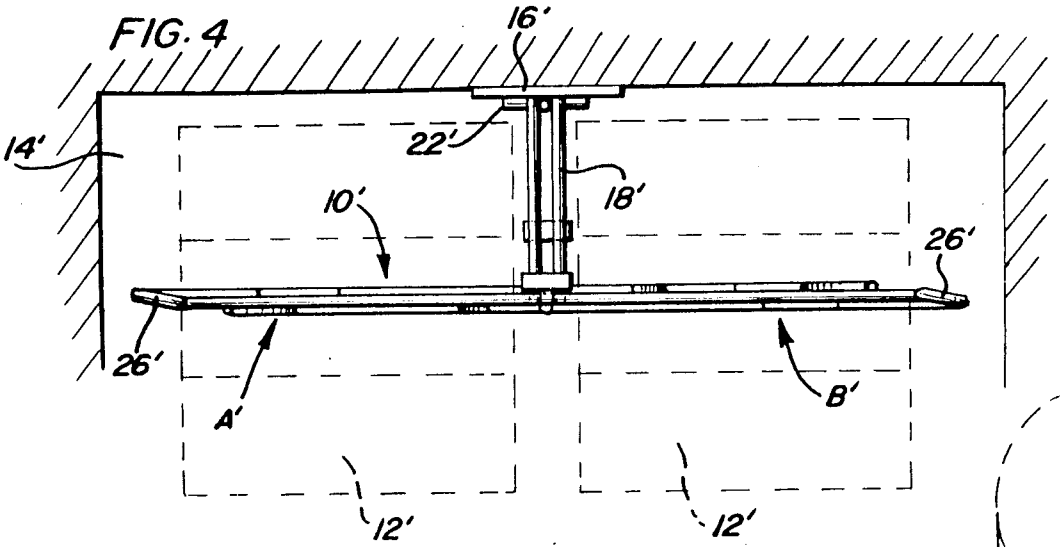
FIG. 4 is a view similar to FIG. 1 of a second form of paper roll holder in accordance with the invention.
Figure 5:
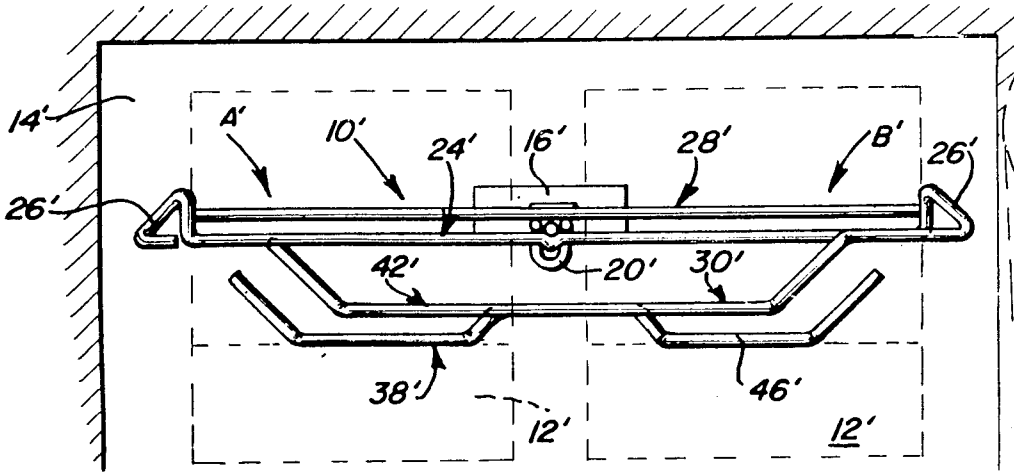
FIG. 5 is a view similar to FIG. 2 of the second form of holder.

FIGS. 4–6 show a holder 10' of generally similar form to the holders shown in FIGS. 1–3, except that the lock is omitted. In either case, the holder frame portion consisting of rods 28 (28') 30 (30') and 42 (42°) could be formed from a single elongated rod suitably bent to shape.

Figure 7:
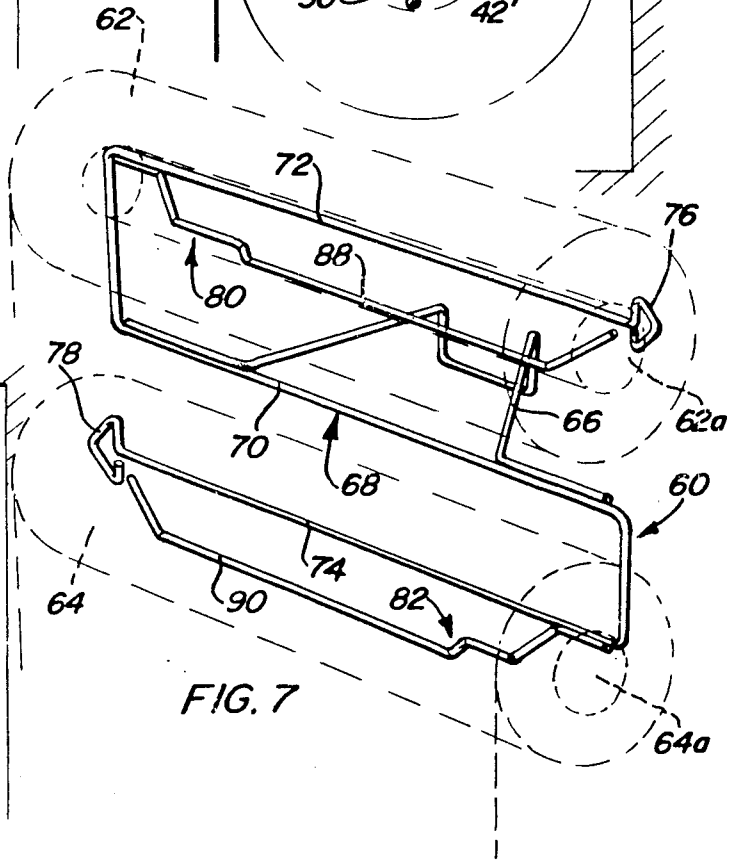
FIG. 7 is a perspective view of a third form of paper roll holder in accordance with the invention.

FIG. 7 shows another form of holder 60 in accordance with the invention for a pair of superposed paper roll 62, 64 such as rolls of paper towels. Holder 60 comprises a mounting bracket 66 of bent rod, similar to the previous rod, a rod 68 bent into the form of an elongated S with a central limb 70 welded to the bracket, and upper and lower limbs 72, 74 with triangular-shaped headed ends 76, 78, a second rod 80 welded at one end underneath limb 72, and a third rod 82 similarly welded to the underneath of limb 74. The limbs 72, 74 again form support arms for the respective paper rolls with rods 80, 82 forming tension arms, and again each of the rods 80, 82 has a double stepped formation defining respective roll-engaging sections 88, 90 parallel to limbs 72, 74 and which are shorter than the cores **62*a*, 64*a*** of the respective paper rolls, as previously described. The rolls can be pushed onto the respective holders, resiliently retained thereon, and pulled off as in the previous embodiments.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A paper roll holder of rod material formed to provide a support arm extending cantilever-wise from a support, and a tension arm extending from one end of the support arm in juxtaposed relation to the support arm, the tension arm being bent to define a roll engaging portion parallel to the support arm and shorter in length than the support arm for resilient deformation of the tension arm toward the support arm and gripping of a paper roll pushed onto the holder from the opposite end of the support arm, said opposite end of the support arm being formed as a headed end and the tension arm has a free terminal end portion inclined from said roll-engaging portion toward said headed end.

2. The invention as defined in claim 1 wherein the tension arm is formed with a first step formation adjacent said one end of the support arm, and a second step formation defining the roll-engaging portion.

3. The invention as defined in claim 1 wherein the support arm and tension arm are replicated on a frame member above and below the support to form upper and lower roll-holding devices.

4. The invention as defined in claim 3 wherein the frame-member is a rod bent to form an elongated S with upper and lower limbs forming the respective support arms.

5. A paper roll holder of rod material formed to provide a support arm extending cantilever-wise from a support, and a tension arm extending from one end of the support arm in juxtaposed relation to the support arm, the tension arm being bent to define a roll engaging portion parallel to the support arm and shorter in length than the support arm for resilient deformation of the tension arm toward the support arm and gripping of a papar roll pushed onto the holder from the opposite end of the support arm, the support arm and tension arm are replicated on opposite sides of the support to form left and right hand roll holder devices with the tension arm of the left hand holder device extending from the support arm of the right hand holder device and the tension arm of the right hand holder device extending from the support arm of the left hand holder device.

6. The invention as defined in claim 5 wherein the respective tension arms each have a first step formation adjacent the respective support arm and a second step formation defining the respective roll-engaging portion.

7. The invention as defined in claim 5 wherein the support arms have headed ends and the tension arms have inclined terminal end portions extending from the roll-engaging portions toward the headed ends.

8. A holder for a pair of paper rolls comprising a support, and rod means defining a pair of support arms extending cantilever-wise in opposite directions from the support, a first resilient tension arm extending from a junction at a distal end of one of said support arms across the holder and providing a first roll-engaging portion in juxtaposition to and parallel with the other of said support arms, and a second resilient tension arm extending from a junction at the distal end of the other of said support arms across the holder and providing a second roll-engaging portion in juxtaposition to and parallel with said one of the support arms, the respective support arms and roll-engaging portions defining left and right push-on, pull-off type of paper roll holder devices.

9. The invention as defined in claim 8 wherein each tension arm has a first step formation adjacent its junction with the respective support arm and a second step formation defining the respective roll-engaging portion.

10. The invention as defined in claim 8 wherein the support arms have headed ends and the tension arms have inclined end portions extending toward the respective headed ends from the respective roll-engaging portions.

11. The invention as defined in claim 10 including a reinforcing rod connected between said headed ends.

12. A holder for a pair of paper rolls comprising a frame of rod material formed as an elongated S with a central limb and upper and lower limbs defining respective roll support arms, a support bracket on the central limb, and a tension arm on the upper and lower limbs, each tension arm extending from a junction at the inboard end of one of said upper and lower limbs in juxtaposition to the respective lib, each of the tension arms having roll-engaging portions which are parallel with and shorter than the respective limbs with each tension arm having a terminal free end spaced from but adjacent the outboard end of the respective limb, each limb and tension arm defining a push-on, pull-off type resilient holder device for a paper roll.

13. The invention as defined in claim 12 wherein the upper and lower limbs have headed portions at their outboard ends, and the respective tension arms have outboard end portions extending in inclined relation from the respective roll-engaging portion toward one of said headed portions.

14. The invention as defined in claim 13 wherein each tension arm has a first step adjacent the respective junction, and a second step defining the respective roll-engaging portion.

* * * * *